US009398648B2

(12) United States Patent
Esaki et al.

(10) Patent No.: US 9,398,648 B2
(45) Date of Patent: Jul. 19, 2016

(54) LIGHTING DEVICE AND ILLUMINATION APPARATUS USING SAME

(75) Inventors: Sana Esaki, Ibaraki (JP); Akinori Hiramatu, Nara (JP)

(73) Assignee: Panasonic Intellectual Property Management Co., LTD., Osaka (JP)

( * ) Notice: Subject to any disclaimer, the term of this patent is extended or adjusted under 35 U.S.C. 154(b) by 145 days.

(21) Appl. No.: 13/277,468

(22) Filed: Oct. 20, 2011

(65) Prior Publication Data

US 2012/0098453 A1 Apr. 26, 2012

(30) Foreign Application Priority Data

Oct. 25, 2010 (JP) ..... 2010-238400

(51) Int. Cl.
*H05B 33/08* (2006.01)

(52) U.S. Cl.
CPC ..... *H05B 33/0815* (2013.01)

(58) Field of Classification Search
CPC .. Y02B 20/42; Y02B 20/346; H05B 33/0815; H05B 33/0839; H05B 33/0842; H05B 33/0818; H05B 33/089; H05B 41/36; H05B 41/34; H05B 41/3927; H05B 37/029
USPC ..... 315/227 R, 291, 307, 247, 241 R, 312, 315/360
See application file for complete search history.

(56) References Cited

U.S. PATENT DOCUMENTS 7,471,287 B2 * 12/2008 Chen et al. ..... 345/212
7,550,934 B1 * 6/2009 Deng et al. ..... 315/308
7,579,786 B2 * 8/2009 Soos ..... 315/291
7,688,008 B2 * 3/2010 Uchida et al. ..... 315/360
7,688,009 B2 * 3/2010 Bayadroun ..... 315/360
7,746,043 B2 * 6/2010 Melanson ..... 323/224
7,764,028 B2 * 7/2010 Mariyama et al. ..... 315/360
7,863,836 B2 * 1/2011 Mednik et al. ..... 315/360
7,888,881 B2 * 2/2011 Shteynberg et al. ..... 315/291
7,898,187 B1 * 3/2011 Mei et al. ..... 315/247
7,903,082 B2 * 3/2011 Sakurai ..... 345/102
8,664,883 B2 * 3/2014 Hiramatu ..... 315/291

(Continued)

FOREIGN PATENT DOCUMENTS

| | | |
|---|---|---|
| JP | 2009-54425 | 3/2009 |
| JP | 2009-134945 | 6/2009 |
| JP | 2010-198760 | 9/2010 |
| WO | 2009/095865 | 8/2009 |

OTHER PUBLICATIONS

STR-A6100 Series Flyback Switching Regulators, Allegro MicroSystems, Inc., Product Description, 2009.*

(Continued)

*Primary Examiner* — Haissa Philogene
(74) *Attorney, Agent, or Firm* — Bacon & Thomas, PLLC

(57) ABSTRACT

A lighting device includes: a lighting unit which outputs a direct current; a smoothing unit having a capacitor which smoothes the direct current outputted from the lighting unit and supplies it; and a control unit for performing an intermittent control which alternately repeats a first time period in which the direct current is supplied to the smoothing unit and a second time period in which the direct current decreases to be smaller than that in the first time period. In the lighting device, a product of a frequency (Hz) and a capacitance (μF) of the capacitor is equal to or greater than 0.05 in which one cycle of the frequency corresponds to a sum of the first time period and the second time period.

2 Claims, 6 Drawing Sheets

(56) References Cited

U.S. PATENT DOCUMENTS

| | | | | |
|---|---|---|---|---|
| 8,723,442 | B2 * | 5/2014 | Omi | H02M 1/36 315/241 R |
| 2004/0135560 | A1 * | 7/2004 | Kernahan et al. | 323/282 |
| 2006/0082538 | A1 * | 4/2006 | Oyama | 345/102 |
| 2007/0040516 | A1 * | 2/2007 | Chen | 315/291 |
| 2007/0120507 | A1 * | 5/2007 | Uchida et al. | 315/360 |
| 2008/0088254 | A1 * | 4/2008 | Yang | 315/247 |
| 2008/0290819 | A1 * | 11/2008 | Hoepfner et al. | 315/306 |
| 2009/0079355 | A1 * | 3/2009 | Zhou et al. | 315/246 |
| 2009/0134817 | A1 * | 5/2009 | Jurngwirth et al. | 315/307 |
| 2010/0019693 | A1 * | 1/2010 | Hoogzaad et al. | 315/294 |
| 2010/0052569 | A1 * | 3/2010 | Hoogzaad et al. | 315/294 |
| 2010/0134038 | A1 * | 6/2010 | Shackle et al. | 315/291 |
| 2010/0181923 | A1 * | 7/2010 | Hoogzaad | 315/185 R |
| 2010/0194274 | A1 * | 8/2010 | Hoogzaad | 315/51 |
| 2010/0244726 | A1 * | 9/2010 | Melanson | 315/291 |
| 2011/0241569 | A1 * | 10/2011 | Zimmermann et al. | 315/301 |

OTHER PUBLICATIONS

A Topology Study of Single-Phase Offline AC/DC Converters for High Brightness White LED Lighting with Power FActor Pre-regulation and Brightness Dimmable, Ahoming Ye, Fred Greenfeld, Ahixiang Liang, Intersil, 2008.*

'Technique for Sizing Input Capacitors in Off-Line Power Converters', IBM Technical Disclosure Bulletin, EN888-0126, S. Kelkar, 1990.*

IBM Technical Disclosure 'Technique for Sizing Input Capacitors in Off-Line Power Converters', S. Kelkar, TBD n4 09-90 p. 396-400, Publication date Sep. 1, 1990.*

Fairchild Semiconductor, Application Note AN4137: Design Guidelines for Off-line Flyback Converters Using Fairchild Power Switch (FPS), 2003.*

Fairchild Semiconductor, Application Note AN4137, Design Guidelines for Off-line Flyback Converters using Fairchild Power Switch (FPS), 2003.*

EAC Electronics, Technical Information, Ripple Factor, 2004.*

Zhongming et al., "A Topology Study of Single-Phase Offline AC/DC Converters for High Brightness White LED Lighting with Power Factor Pre-regulation and Brightness Dimmable", 34th Annual Conference of IEEE, Piscataway, NJ, USA, Nov. 10, 2008, pp. 1961-1967.

The extended European search report dated Apr. 11, 2012.

Japanese Office Action dated Jun. 3, 2014 issued in corresponding Japanese application No. 2010-238400 and the English summary thereof.

* cited by examiner

LIGHTING DEVICE AND ILLUMINATION APPARATUS USING SAME

FIELD OF THE INVENTION

The present invention relates to a lighting device and an illumination apparatus using the same.

BACKGROUND OF THE INVENTION

Conventionally, there is known a lighting device using light emitting diodes (LEDs) as a light source. In order to control the LED brightness, the conventional lighting device performs PWM dimming control in which a current flowing in the LED intermittently stops at a low frequency within a range from about 100 Hz to several kHz, or amplitude dimming control for changing an amplitude of the LED current. In the PWM dimming control, brightness of the LED is controlled by changing a time period (on duty) for supplying the LED with a current, and controlling an average value of an optical power (LED current). In the amplitude dimming control, brightness of the LED is controlled by changing a magnitude (amplitude) of the LED current, and controlling an average value of the optical power (LED current).

When the PWM dimming control is performed by using the PWM signal, it is preferable to set a frequency of the PWM signal to be equal to or greater than 100 Hz in order to suppress flickering of the LED. By setting the frequency of the PWM signal to be equal to or greater than 100 Hz, human eyes cannot notice the flickering under the LED illumination.

However, when the frequency of the PWM signal is set to be equal to or greater than 2 kHz, an on/off time interval is reduced in a region having a high illumination level. Accordingly, it becomes difficult to exactly control a switching device by using a pulse. Further, a noise occurs due to a transformer or the like. For that reason, when the PWM dimming control is performed, it is preferable to set the frequency of the PWM signal ranging from 100 Hz to 2 kHZ.

Further, there is disclosed an illumination apparatus capable of performing stable dimming control in a region having a high illumination level and suppressing a noise due to the transformer by combining the PWM dimming control and the amplitude dimming control (see, e.g., Japanese Patent Application Publication No. 2009-54425).

FIG. 7 shows waveform diagrams of the LED current supplied to the LED and the PWM signal in the PWM dimming control. As shown in FIG. 7, a light increasing period T11 and a light decreasing period T12 are alternately repeated, and, actually, the LED is turned on/off at the frequency of PWM signal. When the frequency of the PWM signal is set to be equal to or greater than 100 Hz, the flickering is seen on the average by the human eyes, which does not cause discomfort.

However, since a video camera captures an image at a constant shutter speed, e.g., 1/120 seconds or the like, flickering occurs on the images captured by the video camera under LED illumination. That is, even though the LED illumination does not cause discomfort to the human eyes, the human eyes can notice the flickering in the image captured by the video camera.

SUMMARY OF THE INVENTION

In view of the above, the present invention provides a lighting device capable of preventing occurrence of a flicker when an image is captured by a video camera under the illumination of the light source, and an illumination apparatus using the lighting device.

In accordance with an aspect of the present invention, there is provided a lighting device including: a lighting unit which outputs a direct current; a smoothing unit having a capacitor which smoothes the direct current outputted from the lighting unit and supplies it to a light source; and a control unit for performing an intermittent control which alternately repeats a first time period in which the direct current is supplied to the smoothing unit and a second time period in which the direct current decreases to be smaller than that in the first time period. In the lighting device, a product of a frequency (Hz) and a capacitance (μF) of the capacitor is equal to or greater than 0.05 in which one cycle of the frequency corresponds to a sum of the first time period and the second time period.

Preferably, a ripple factor in the smoothed direct current is equal to or less than 15%.

In accordance with another aspect of the present invention, there is provided an illumination apparatus including: the lighting device described above, and a light source which is turned on by the smoothed direct current outputted from the lighting device.

With the above configuration, it is possible to prevent flickering from occurring when an image is captured by the video camera under illumination of the light source.

BRIEF DESCRIPTION OF THE DRAWINGS

Objects and features of the present invention will become apparent from the following description of embodiments, given in conjunction with the accompanying drawings, in which.

DETAILED DESCRIPTION OF THE EMBODIMENTS

Hereinafter, embodiments of the present invention will be described with reference to the accompanying drawings which form a part hereof.

First Embodiment

Figure 2:
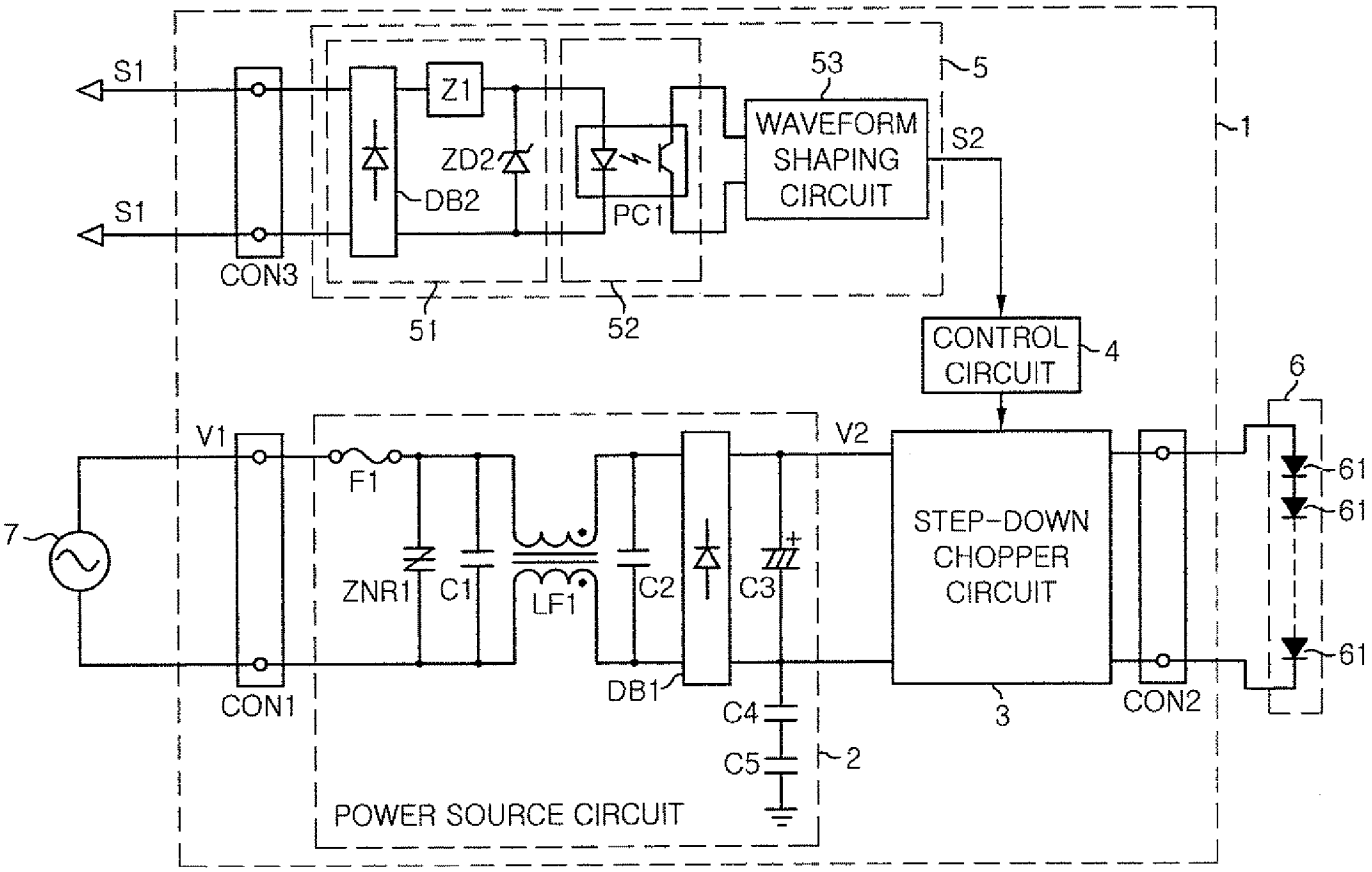
FIG. 2 shows a schematic configuration of the lighting device.

FIG. 2 illustrates a circuit configuration of a lighting device 1 in accordance with a first embodiment of the present invention.

The lighting device 1 of this embodiment includes a power circuit 2, a step-down chopper circuit 3, a control circuit 4 and a signal process unit 5.

The lighting device 1 is supplied with power from a commercial power source 100 (e.g., 100 V, 50/60 Hz) via a connector CON1. The power circuit 2 converts an alternating current (AC) voltage V1 into a rectified voltage V2. Further, a dimming signal S1 is inputted to the signal processing unit 5 via a connector CONS, and the signal processing unit 5 performs a process on the dimming signal S1 to produce a PWM signal S2. The PWM signal S2 is outputted to the control circuit 4.

Further, the step-down chopper circuit 4 is connected to the light source 6 via a connector CON2. In the present embodiment, the light source 6 includes at least one semiconductor light emitting element (LED element) 61. The light source 6 is not limited thereto, and may include an LED module having a plurality of LED elements 61 connected to each other by serial, parallel, or mixed connection.

Further, although the LED element 61 are used as a semiconductor light emitting element in this embodiment, an organic electroluminescence (EL) device or a semiconductor laser device may be used.

The control circuit (dimming control unit) 4 may control dimming of the light source 6 by changing an output current of the step-down chopper circuit 3 based on a PWM signal S2.

Hereinafter, a detailed configuration of each unit will be described.

Figure 1:
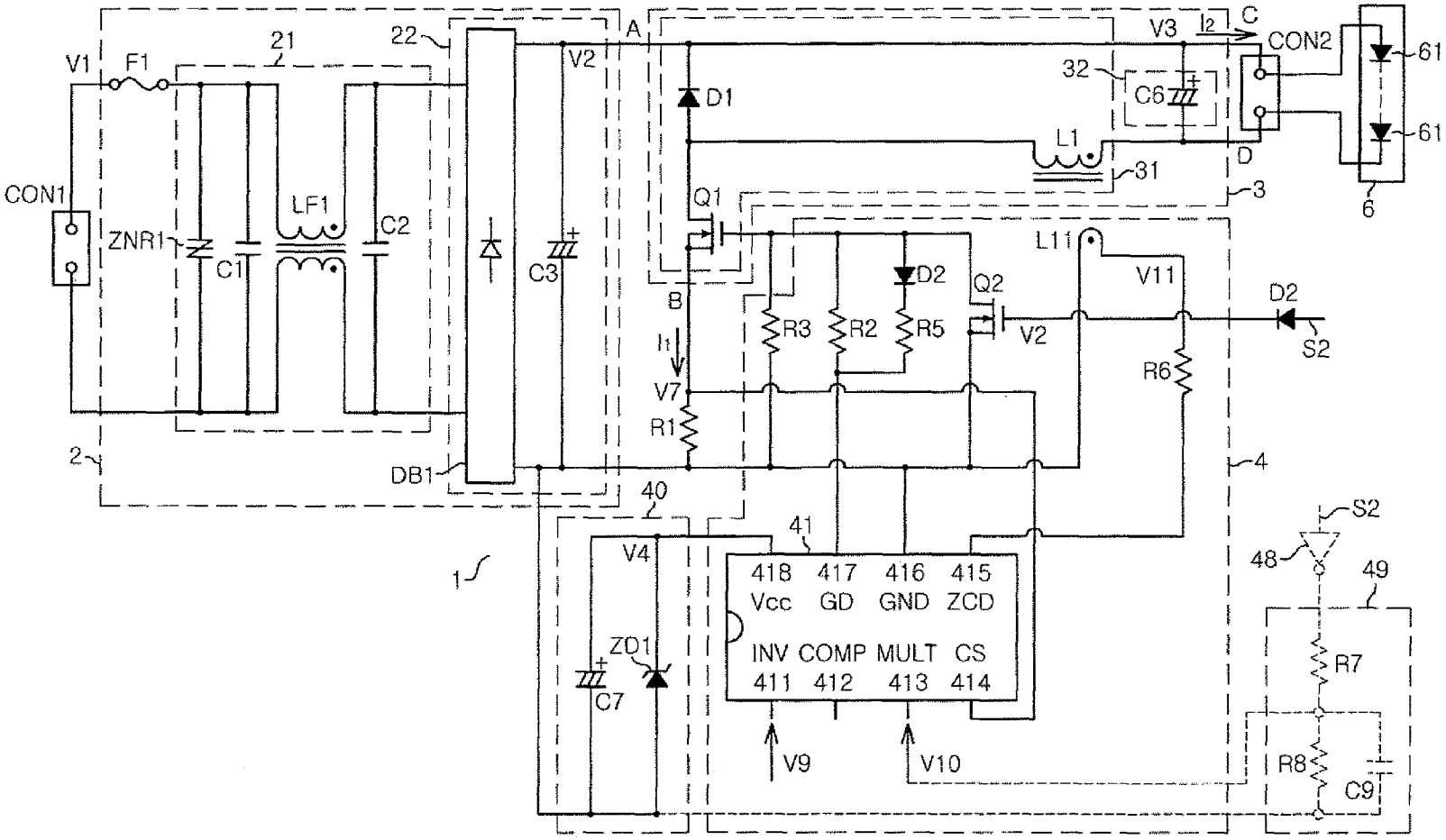
FIG. 1 illustrates a circuit configuration of a lighting device in accordance with a first embodiment of the present invention.

FIG. 1 shows circuit configurations of the power circuit 2, the step-down chopper circuit 3, and the control circuit 4.

The power circuit 2 includes a fuse F1, a filter circuit 21, and a rectifying and smoothing circuit 22.

The filter circuit 21 is supplied with an AC voltage V1 from the commercial power source 7 via the connector CON1 and the fuse F1. The filter circuit 21 includes a surge voltage absorber ZNR1, capacitors C1 and C2, and a common mode choke coil LF1 to remove a noise in the AC voltage V1 supplied from the commercial power source 7.

The rectifying and smoothing circuit 22 includes a full-wave rectifier circuit DB1 and a smoothing capacitor C3 to rectify and smooth the AC voltage V1, thereby generating a rectified voltage V2 between both terminals of the smoothing capacitor C3. Further, capacitors C4 and C5 may be connected in series between a negative electrode of the smoothing capacitor C3 and ground as shown in FIG. 2. The rectifying and smoothing circuit 22 may include a power factor improving circuit using a step-up chopper circuit.

Further, the power circuit 2 is conventionally well known, and a detailed description thereof is omitted.

Next, the step-down chopper circuit 3 will be described.

The step-down chopper circuit 3 includes an inductor L1, a switching device Q1 having an n-channel MOSFET, a diode D1 and a capacitor C6 of an electrolytic capacitor. A series circuit having the capacitor C6, the inductor L1, the switching device Q1 and a resistor R1 is connected between output terminals of the rectifying and smoothing circuit 22. The diode D1 is connected in parallel to the capacitor C6 and the inductor L1. Herein, the inductor L1, the switching device Q1, and the diode D1 correspond to a lighting unit 31 of the present invention, and the capacitor C6 corresponds to a smoothing unit 32 of the present invention.

The light source 6 is connected to both terminals of the capacitor C6 with a connector CON2 interposed therebetween.

When the switching device Q1 is turned on, a direct current I1 flows through the capacitor C6, thereby charging the capacitor C6. The capacitor C6 discharges when the switching device Q1 is turned off. As described above, the switching device Q1 is turned on and off alternately and the capacitor C6 charges and discharges repeatedly. Accordingly, the rectified voltage V2 is stepped down, and a capacitor voltage V3 is generated between both terminals of the capacitor C6. Further, an LED current I2 (smoothing current) is supplied to the light source 6 by using the capacitor voltage V3 as a power source.

The control circuit 4 controls the LED current I2 by turning on or off the switching device Q1, thereby controlling the dimming of the light source 6. The control circuit 4 includes an integrated circuit 41 for control and a peripheral circuit thereof.

Figure 3:
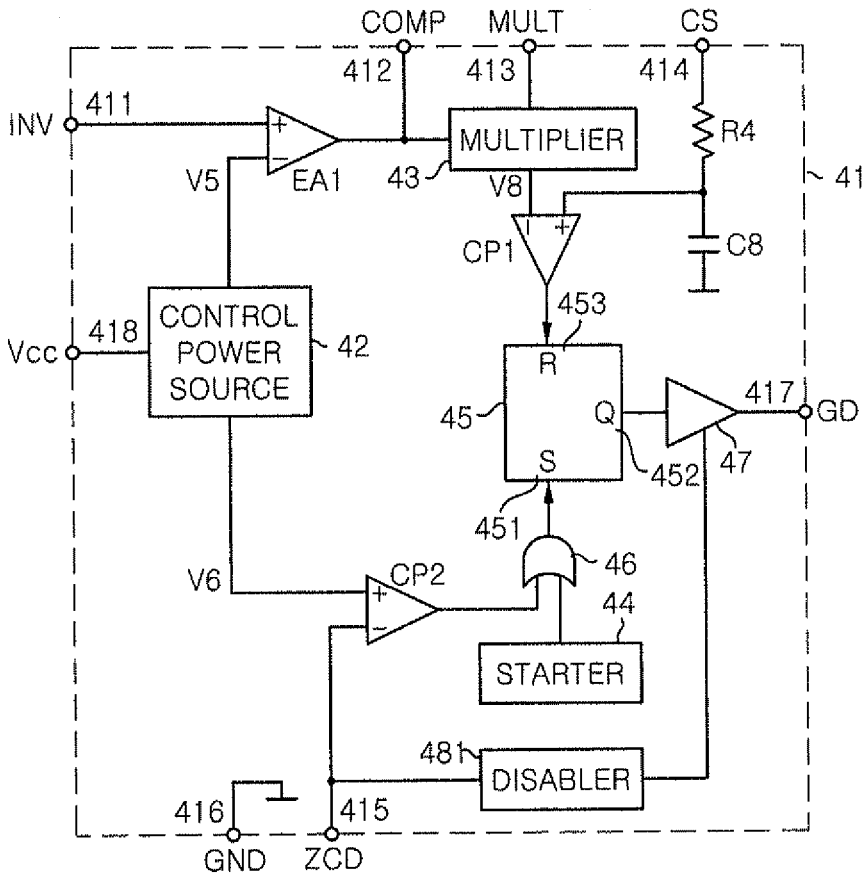
FIG. 3 is a block diagram showing an inner configuration of an integrated circuit for control.

FIG. 3 illustrates an inner configuration of the integrated circuit 41 for control.

An INV pin 411 is connected to an inverting input terminal of an error amplifier (error AMP) EA1. A COMP pin 412 is connected to an output terminal of the error amplifier EA1. A MOLT pin 413 is connected to an input terminal of a multiplier circuit 43. A CS pin 414 functions as a chopper current detection terminal. A ZCD pin 415 functions as a zero-cross detection terminal. A GND pin 416 functions as a ground terminal. A GD pin 417 functions as a gate drive terminal. A Vcc pin 418 functions as a power terminal.

When a control voltage V4 of magnitude equal to or greater than a predetermined voltage is applied between the Vcc pin 418 and the GND pin 416, a control power source 42 generates reference voltages V5 and V6, thereby enabling operation of parts in the integrated circuit 41 for control.

In this embodiment, there is provided the control power circuit 40 in which a capacitor C5 and a Zener diode ZD1 are connected in parallel to each other. A Zener voltage of the Zener diode ZD1 serves as the control voltage V4. For simplicity of configuration, a high resistor (not shown) is connected between a positive electrode of the capacitor C3 and a positive electrode of the capacitor C5, and the rectified voltage V2 outputted from the rectifying and smoothing circuit 22 is inputted to the control power circuit 40.

When the control voltage V4 is applied to the integrated circuit 41 for control, firstly, a starter 44 outputs a start pulse to a set input terminal (S terminal) 451 of a flip-flop 45 via an OR gate 46. Accordingly, an output level of an output terminal (Q terminal) 452 of the flip-flop 45 becomes a high level. Further, an output level of the GD pin 417 also becomes a high level via a driving circuit 47.

A series circuit of resistors R2 and R3 is connected between the GD pin 417 and the ground, and a connection point between the resistors R2 and R3 is connected to a gate of the switching device Q1. When the output level of the GD pin 417 becomes a high level, a voltage divided by the resistors R2 and R3 is applied between a gate and a source of the switching device Q1, thereby turning on the switching device Q1. Further, since the resistor R1 has a small resistance used in current detection, the resistor R1 hardly affects the voltage applied between the gate and the source.

When the switching device Q1 is turned on, the direct current I1 flows through a path of the capacitor C4, the inductor L1, the switching device Q1 and the resistor R1 from the rectifying and smoothing circuit 22. In this case, the direct current I1 flowing in the inductor L1 almost linearly increases unless the inductor L1 is magnetically saturated. Further, the resistor R1 is a detection resistor of the direct current I1 while the switching device Q1 is turned on. A voltage V7 between both terminals of the resistor R1 serves as a detection signal of the direct current I1 and is outputted to the CS pin 414 of the integrated circuit 41 for control.

Further, the voltage V7 inputted to the CS pin 414 is applied to a non-inverting input terminal of a comparator CP1 via a noise filter having a resistor R4 and a capacitor C8. Further, in this embodiment, the resistor R4 is 40 kΩ and the capacitor C8 is 5 pF. A reference voltage V8 is applied to an inverting input terminal of the comparator CP1. The reference voltage V8 is an output voltage of the multiplier circuit 43 and, is determined based on a voltage V9 applied to the INV pin 411 and a voltage V10 applied to the MULT pin 413.

If the direct current I1 flowing in the inductor L1 becomes equal to or greater than a predetermined value and the voltage V7 across the resistor R1 is equal to or greater than the reference voltage V8, the output level of the comparator CP1 becomes a high level, and a signal of a high level is inputted to a reset input terminal (R terminal) 453 of the flip-flop 45. Accordingly, the output level of the output terminal (Q terminal) 452 of the flip-flop 45 becomes a low level.

When the output level of the output terminal (Q terminal) 452 of the flip-flop 45 becomes a low level, an output level of the driving circuit 47 becomes a low level, and a current flows into the integrated circuit 41 from the GD pin 417. A series circuit of a diode D2 and a resistor R5 is connected in parallel to the resistor R2. The driving circuit 47 immediately turns off the switching device Q1 by pulling charges between the gate and the source of the switching device Q1 via the diode D2 and the resistor R5.

When the switching device Q1 is turned off, a regenerative current flows via the diode D1 based on the electromagnetic energy accumulated in the inductor L1 and the capacitor C4 discharges. Herein, a voltage across the inductor L1 is clamped to the voltage V3 between both terminals of the capacitor C6. If the inductor L1 has an inductance L1*a*, the regenerative current flowing in the inductor L1 decreases with an almost constant gradient ($di/dt \approx -V3/L1a$)

If the voltage V3 across the capacitor C6 is high, the regenerative current rapidly decreases. If the capacitor voltage V3 is low, the regenerative current gradually decreases. That is, although a peak value of the regenerative current flowing in the inductor L1 is constant, the time required until the regenerative current vanishes varies depending on a load voltage. The time required becomes short as the capacitor voltage V3 is high, and becomes long as the capacitor voltage V3 is low.

Further, while the regenerative current flows, a secondary voltage V11 is generated between both terminals of a secondary coil L11 of the inductor L1 and decreases with the gradient of the regenerative current. The secondary voltage V11 is outputted to a ZCD pin 415 as a detection signal of the regenerative current via a resistor R6. The secondary voltage V11 becomes zero as the regenerative current becomes zero.

An inverting input terminal of a comparator CP2 for zero-cross detection is connected to the ZCD pin 415. Further, the reference voltage V6 is applied to a non-inverting input terminal of the comparator CP2. Further, when the regenerative current decreases and the secondary voltage V11 is equal to or smaller than the reference voltage V6, the output level of the comparator CP2 becomes a high level.

Accordingly, a signal of a high level is outputted to the set input terminal (S terminal) 451 of the flip-flop 45 via the OR gate 46. Further, the output level of the output terminal (Q terminal) 452 of the flip-flop 45 becomes a high level, and the output level of the GD pin 417 becomes a high level, thereby turning on the switching device Q1.

As described above, the switching device Q1 is turned on/off by repeating the above operation, and the capacitor voltage V3 stepped down from the rectified voltage V2 is generated between both terminals of the capacitor C4. Thus, the LED current I2 supplied to the light source 6 is controlled to be a constant current. Further, the light source 6 includes a plurality of LED elements 61 connected to each other in series. If a forward voltage of the LED elements 61 is Vf and the number of LED elements 61 connected in series to each other is n, the capacitor voltage V3 is almost clamped to Vf×n.

Next, dimming control of the light source 6 will be described.

In the lighting device of this embodiment, a high frequency chopper operation intermittently stops in accordance with a low frequency PWM signal S2. Accordingly, the LED current I2 is supplied to the light source 6 based on the duty of the PWM signal S2, thereby dimming the light source 6.

A switching device Q2 including an n-channel MOSFET is connected between the ground and a gate terminal of the switching device Q1. The PWM signal S2 is inputted to a gate terminal of the switching device Q2.

The PWM signal S2 is a square wave voltage signal having a low frequency ranging from, e.g., about 100 Hz to 2 kHz. The PWM signal S2 is configured such that a brightness level increases as a low level period in one cycle is long. This type of the PWM signal S2 is widely used in a lighting device for illumination such as a fluorescence lamp.

As shown in FIG. 2, a dimming signal S1 is inputted from a dimmer (not shown) provided externally, and the signal processing unit 5 generates a PWM signal S2 based on the dimming signal S1 and outputs it to the control circuit 4. The signal processing unit 5 includes a rectifying circuit 51, an isolation circuit 52 having a photo coupler PC1, and a waveform shaping circuit 53. The rectifying circuit 51 has a diode bridge DB2, an impedance Z1 and a Zener diode ZD2.

The rectifying circuit 51 rectifies the dimming signal S1 and outputs the rectified signal to the photo coupler PC1 of the isolation circuit 52. Further, the waveform shaping circuit 53 determines a duty ratio of the PWM signal S2 based on a current value flowing in the photo coupler PC1, and outputs the PWM signal S2 to the control circuit 4. The signal processing unit 5 is conventionally well known, and a detailed description thereof will be omitted.

The PWM signal S2 outputted from the signal processing unit 5 is outputted to a gate terminal of the switching device Q2 via a diode D2.

When the PWM signal S2 is at a high level, the switching device Q2 is turned on. Accordingly, the gate terminal of the switching device Q1 is connected to the ground. That is, while the PWM signal S2 is at a high level, an off state of the switching device Q1 is maintained regardless of the output level of the GD pin 417, and a chopper operation (switching operation of the switching device Q1) stops. During the chopper operation stop period T2 (second time period), the direct current I1 is not supplied from the rectifying and smoothing circuit 22 to the capacitor C6. Accordingly, the capacitor C6 discharges and the capacitor voltage V3 decreases.

When the PWM signal S2 is at a low level, the switching device Q2 is turned off (in a high impedance state). That is, when the PWM signal S2 is at a low level, a normal chopper operation for turning on/off the switching device Q1 is performed in accordance with the output level of the GD pin 417. During a chopper operation period T1 (first time period), the switching device Q1 is turned on/off, and the capacitor voltage V3 is generated between both terminals of the capacitor C6, thereby supplying the light source 6 with the LED current I2.

Accordingly, a ratio of the chopper operation period to the chopper operation stop period coincides with a ratio (duty ratio) of the low level period to the high level period of the PWM signal S2. During the chopper operation period T1, since the capacitor voltage V3 increases, the LED current I2 increases. During the chopper operation stop period T2, since the capacitor voltage V3 decreases, the LED current I2 decreases. Thus, the LED current I2 depending on a ratio of a low level period to one cycle T0 (=T1+T2) of the PWM signal S2 is supplied to the light source 6. This makes it possible to perform dimming control (PWM dimming control) of the light source 6 by varying a duty ratio of the PWM signal S2.

Figure 7:
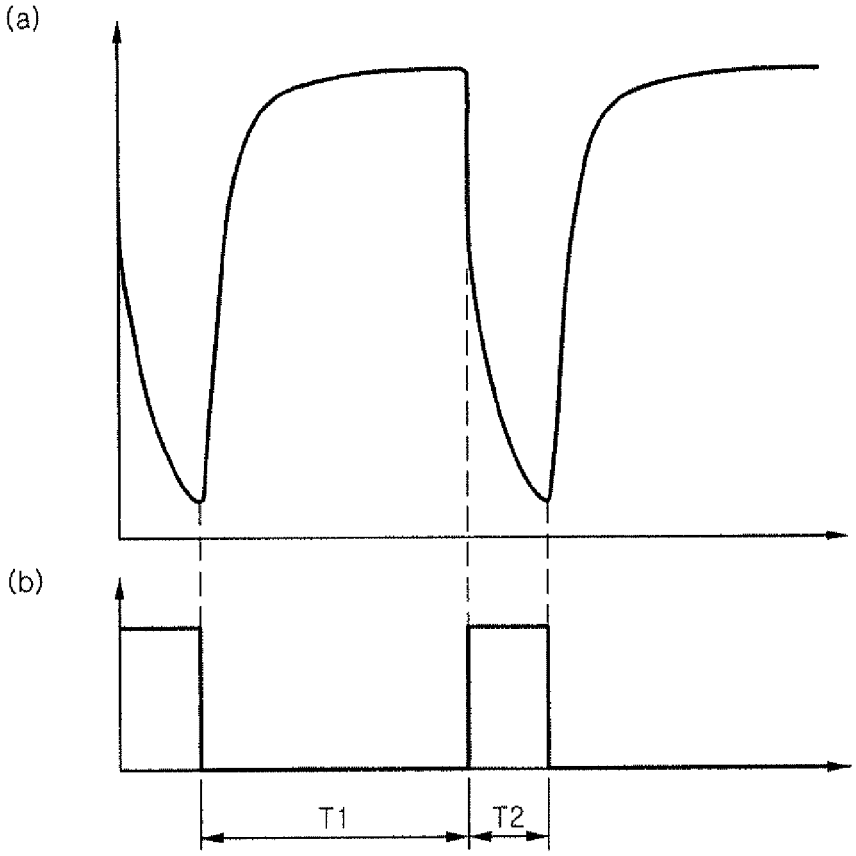
FIG. 7 illustrates waveform diagrams of an LED current and a PWM signal in a conventional case.

In a conventional lighting device, when dimming a light source, there occurs a large ripple in LED current supplied to the light source. For that reason, when an image captured by a video camera is displayed on a monitor, flickering occurs (see FIG. 7).

However, in the lighting device of this embodiment, a product of a frequency fp (Hz) of the PWM signal S2 and a capacitance C6*p* (μF) of the capacitor C6 is set to be equal to or greater than 0.05 (i.e., fp(Hz)×C6*p*(μF)≥0.05) in order to reduce a ripple factor of the LED current I2.

Figure 4:
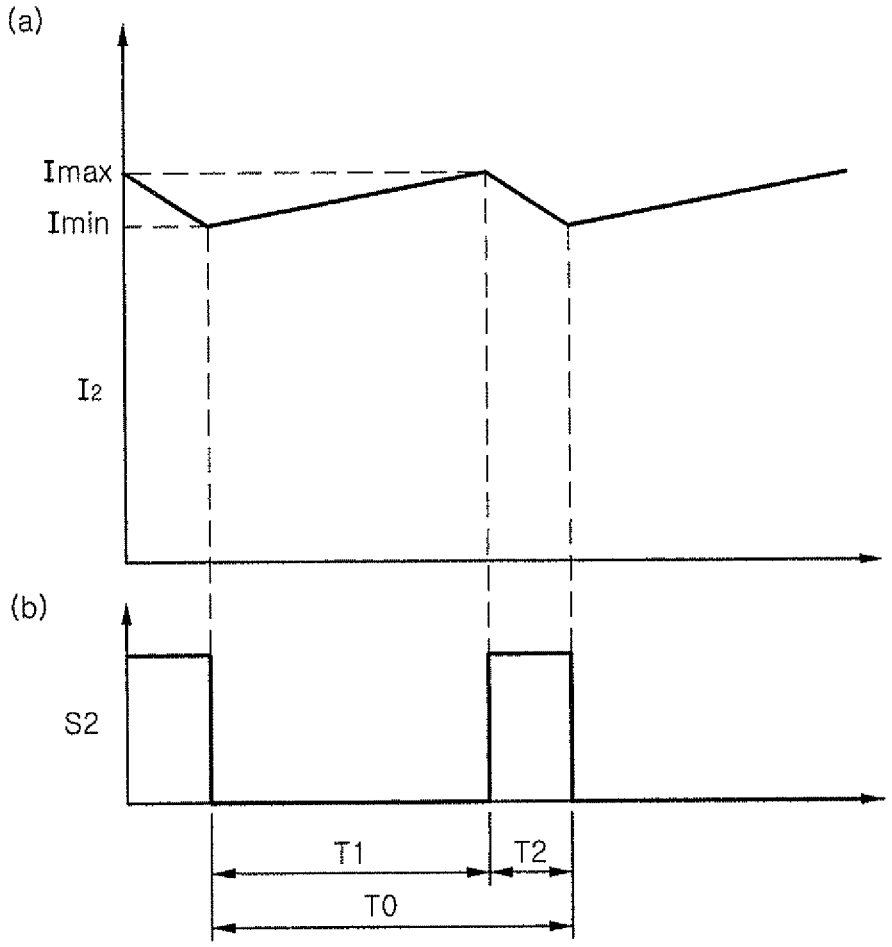
FIG. 4 depicts waveform diagrams of an LED current and a PWM signal.

For example, in a case where the frequency fp (=1/T0) of the PWM signal S2 is 100 Hz, the capacitance C6*p* (μF) of the capacitor C6 of this embodiment is set to be 500 μF. A waveform diagram of the LED current I2 of this case is illustrated in FIG. 4. The LED current I2 of this case has a maximum value Imax of 260 mA immediately before the chopper operation stop, a minimum value Imin of 225 mA immediately before the chopper operation start, and an effective value Irms of 235 mA. The ripple factor of the LED current I2 is as follows.

$$\text{Ripple factor (\%)} = (I\max - I\min / I\text{rms}) \times 100$$

$$= (260\ (\text{mA}) - 225\ (\text{mA}) / 235\ (\text{mA})) \times 100$$

$$= 15\ (\%))$$

As described above, by setting the product of the frequency fp (Hz) of the PWM signal S2 and the capacitance C6*p* (μF) of the capacitor C6 to be equal to or greater than 0.05, it is possible to make the ripple factor of the LED current I2 within 15%. When the ripple factor of the LED current I2 is set to be within 15%, a difference between the maximum and the minimum values of the LED current I2 is small. Therefore, when an image captured by a video camera under illumination of the light source 6 is shown by a monitor, flickering is not perceived.

With the lighting device 1 of this embodiment, it is possible to prevent occurrence of flickering when an image is captured by a video camera under the illumination of the light source 6.

Further, the frequency of the PWM signal S2 is not limited to 100 Hz as described above. For example, if the frequency is 1 kHz, by setting the capacitance of the capacitor C6 to be equal to or greater than 50 μF, it is possible to make the ripple factor of the LED current I2 within 15%, and the same effect can be obtained.

Further, in a case where the PWM signal S2 has a variable frequency, the capacitance of the capacitor C6 is determined using a lower limit of the frequency of the PWM signal S2.

In the present embodiment, the step-down chopper circuit 3 includes a series circuit having the capacitor C6, the inductor L1 and the switching device Q1, and the diode D1 connected in parallel to the capacitor C6 and the inductor L1, as shown in FIG. 1. However, it is not limited thereto.

Figure 5A:
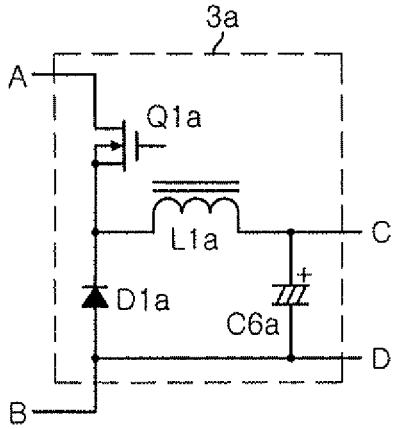
FIGS. 5A to 5D illustrate circuit diagrams of a step-down chopper circuit, a step-up chopper circuit, a flyback converter, and an inverting chopper circuit.

For example, as shown in FIG. 5A, there may be provided a step-down chopper circuit 3*a* in which a switching device Q1*a* is provided at an upstream side. The step-down chopper circuit 3*a* includes a series circuit having a capacitor C6*a*, an inductor L1*a* and a switching device Q1*a*, and a diode D1 connected in parallel to the capacitor C6*a* and the inductor L1*a*.

Figure 5B:
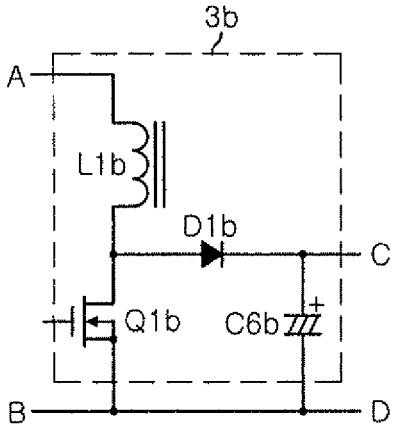

Further, in consideration of loads, there may be provided a step-up chopper circuit 3*b* including a series circuit having an inductor L1*b*, a diode D1*b* and a capacitor C6*b*, and a switching device Q1*b* connected in parallel to the diode D1*b* and the capacitor C6*b*, as shown in FIG. 5B.

Figure 5C:
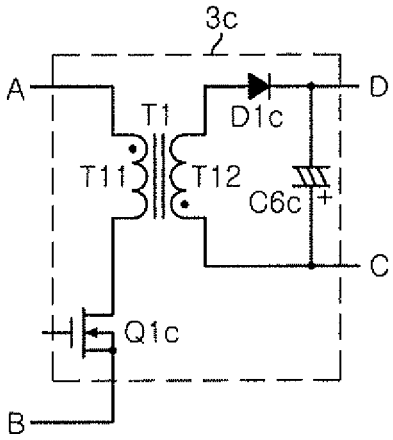

Further, as shown in FIG. 5C, there may be provided a flyback converter 3*c* including a switching device Q1*c* connected to a primary coil T11 of a transformer T1, and a series circuit of a capacitor C6*c* and a diode D1*c* connected between both terminals of a secondary coil T12.

Figure 5D:
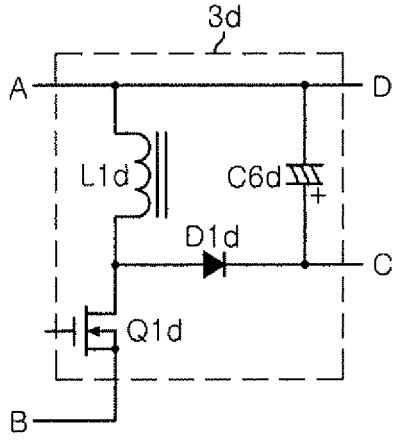

Furthermore, as shown in FIG. 5D, there may be provided an inverting chopper circuit 3*d* including a series circuit of an inductor L1*d* and a switching device Q1*d*, and a diode D1*d* and a capacitor C6*d* connected in parallel to the inductor L1*d*.

In the above embodiment, the control power circuit 40 of this embodiment generates the control voltage V4 based on the rectified voltage V2. However, the control voltage V4 may be obtained by using the secondary voltage V11 generated between both terminals of the secondary coil L11 of the inductor L1. It is possible to improve power efficiency by charging a capacitor C7 by using the secondary voltage V11 in the chopper operation.

In this embodiment, a timing when the regenerative current flowing in the inductor L1 becomes almost zero is detected by detecting the secondary voltage V11 between both terminals of the secondary coil L11 of the inductor L1. However, it is not limited thereto. For example, a timing when the regenerative current vanishes may be detected by a method of detecting an increase in a backward voltage of the diode D1, or a method of detecting a drop in a voltage between drain and source of the switching device Q1.

Further, although the PWM dimming for PWM controlling the direct current I1 is performed by using the PWM signal S2 outputted to the gate of the switching device Q2 in this embodiment, the dimming of the light source 6 may be controlled by combining amplitude dimming for controlling the amplitude of the direct current I1 with the PWM dimming control. Hereinafter, the amplitude control will be described.

As a voltage applied to the MULT pin 413 of the integrated circuit 41 for control increases, a peak value of the direct current I1 increases. Further, for example, as shown by a dotted line in FIG. 1, the PWM signal S2 is converted into the direct current (DC) voltage V10 by using an integration circuit 49 including an inverter 48, resistors R7 and R9 and a capacitor C9, and the DC voltage V10 is applied to the MULT pin 413. Since the inverter 48 is used, the DC voltage V10 increases as the on-duty of the PWM signal S2 decreases (the illumination level increases).

As the DC voltage V10 increases, the reference voltage V8 outputted from the multiplier circuit 43 increases. Accordingly, a timing of changing an ON state of the switching device Q1 to an OFF state is late, and a peak value of the direct current I1 increases. Further, since the amplitude of the LED current I2 becomes large, it is possible to increase the illumination level of the light source 6. In this case, since the ON time of the switching device Q1 becomes long, a switching frequency (chopping frequency) of the switching device Q1 becomes low.

On the other hand, as the on-duty of the PWM signal S2 increases (the illumination level decreases), the DC voltage V10 decreases. As the DC voltage V10 decreases, the reference voltage V8 outputted from the multiplier circuit 43 decreases. Accordingly, a timing of changing an ON state of the switching device Q1 to an OFF state is faster, and a peak value of the direct current I1 decreases. Further, since the amplitude of the LED current I2 becomes small, it is possible to decrease the illumination level of the light source 6. In this case, since the ON time of the switching device Q1 becomes short, a switching frequency (chopping frequency) of the switching device Q1 becomes high.

As described above, the amplitude dimming control of the light source 6 can be performed by using the PWM signal S2, and the dimming of the light source 6 can be controlled by combining the PWM dimming with the amplitude dimming.

Further, although the output of the integration circuit 49 is applied to the INV pin 411, the amplitude Alternatively, by controlling a voltage applied to the CS pin 414 or the ZCD pin 415 based on the PWM signal 32, it is possible to forcibly turn off the switching device Q1 and perform the PWM illumination of the light source 6.

Further, the above-described dimming control method of the light source 6 may be used in combination.

In the inner configuration of the integrated circuit for control shown in FIG. 3, a disabler 481 has a function of stopping the driving circuit 47 when a specific voltage is applied to the ZCD pin 415.

Second Embodiment

Figure 6:
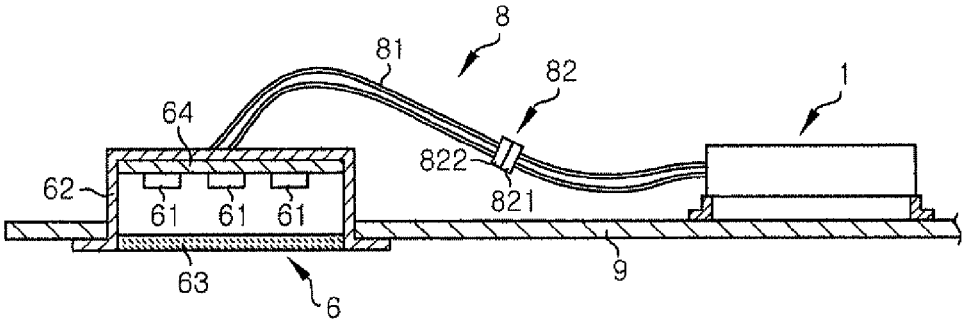
FIG. 6 schematically shows an external appearance of an illumination apparatus in accordance with a second embodiment of the present invention.

An illumination apparatus 8 in accordance with a second embodiment of the present invention includes the light source 6 and the lighting device 1 of the first embodiment. FIG. 6 illustrates a schematic cross-sectional view of the illumination apparatus 8.

In the illumination apparatus 8 of this embodiment, the light source 6 and the lighting device 1 serving as a power source unit are separately provided and electrically connected to each other via lead wires 81. By separately providing the lighting device 1 and the light source 6, the light source 6 can become thinner. Further, a degree of freedom in an installation place of the lighting device 1 is improved.

The light source 6 is an LED module having the LED elements 61, a housing 62, a light diffusion plate 63 and a mounting substrate 64. The light source 6 is buried in a ceiling 9 from which a surface of the light source 6 is exposed.

The housing 62 is formed of a cylindrical metal body with one surface opened, and the opening of the housing 62 is covered with the light diffusion plate 63. Further, the mounting substrate 64 is installed at a bottom surface of the housing 62 facing the light diffusion plate 63. Further, a plurality of LED elements 61 is mounted on one surface of the mounting substrate 64, and light from the LED elements 61 is diffused by the light diffusion plate 63 and illuminated toward the floor.

Since the lighting device 1 is provided separately from the light source 6, the lighting device 1 can be installed at a position separated from the light source 6. In this embodiment, the lighting device 1 is installed at a backside of the ceiling 9. Further, the output of the step-down chopper circuit 3 of the lighting device 1 is applied to the light source 6 via the lead wires 81 and a connector 82, so that the LED current I2 is supplied to the light source 6. The connector 82 includes a connector 821 for the lighting device 1 and a connector 822 for the light source 6 which are detachable. Further, the lighting device 1 and the light source 6 can be detached from each other in maintenance.

Since the illumination apparatus 8 of this embodiment includes the lighting device 1 of the first embodiment, it is possible to prevent occurrence of flickering when an image is captured by a video camera under the illumination of the light source 6.

Further, although the lighting device 1 and the light source 6 are separately provided in this embodiment, the lighting device 1 and the light source 6 may be formed integrally with each other.

In this embodiment, although the lighting device 1 is used in the illumination apparatus 8, the lighting device 1 may be used to turn on, e.g., a backlight of a liquid crystal display (LCD), or a light source of a copy machine, a scanner, a projector or the like.

While the invention has been shown and described with respect to the embodiments, it will be understood by those skilled in the art that various changes and modification may be made without departing from the scope of the invention as defined in the following claims.

What is claimed is:

1. A lighting device comprising:

a lighting unit including a switching device and configured to output a direct current;

a smoothing unit having a capacitor configured to smooth the direct current outputted from the lighting unit and supply the smoothed direct current to a light source;

a signal processing unit configured to generate a PWM signal; and a control unit adapted to control the switching device to alternately repeat a turning on and off of the switching device during a first time period while the PWM signal is a high level and to maintain an off state of the switching device during a second time period while the PWM signal is a low level, wherein during the first time period, the smoothed direct current is increased and during the second time period, the smoothed direct current is decreased, wherein a product of a frequency of the PWM signal and a capacitance of the capacitor is equal to or greater than 0.05 in order to set a ripple factor in the smoothed direct current to be 15% or less, wherein the ripple factor is defined as:

$$((I_{max}-I_{min})/I_{rms})\times 100,$$

where $I_{max}$ is a maximum current value of the smoothed direct current, $I_{min}$ is a minimum current value of the smoothed direct current, and $I_{rms}$ is an effective current value of the smoothed direct current, and wherein a unit of the frequency is hertz and a unit of capacitance is farad.

2. An illumination apparatus comprising:

a lighting unit including a switching device and configured to output a direct current;

a smoothing unit having a capacitor configured to smooth the direct current outputted from the lighting unit and supply the smoothed direct current to a light source;

a signal processing unit configured to generate a PWM signal; and a control unit adapted to control the switching device to alternately repeat a turning on and off of the switching device during a first time period while the PWM signal is a high level and to maintain an off state of the switching device during a second time period while the PWM signal is a low level, wherein during the first time period, the smoothed direct current is increased and during the second time period, the smoothed direct current is decreased, wherein a product of a frequency of the PWM signal and a capacitance of the capacitor is equal to or greater than 0.05 in order to set a ripple factor in the smoothed direct current to be 15% or less, wherein the ripple factor is defined as:

$$((I_{max}-I_{min})/I_{rms})\times 100,$$

where $I_{max}$ is a maximum current value of the smoothed direct current, $I_{min}$ is a minimum current value of the smoothed direct current, and $I_{rms}$ is an effective current value of the smoothed direct current, wherein a unit of the frequency is hertz and a unit of capacitance is farad, and wherein the light source is turned on by the smoothed direct current outputted from a lighting device.

* * * * *